US007043909B1

(12) United States Patent
Steele

(10) Patent No.: US 7,043,909 B1
(45) Date of Patent: May 16, 2006

(54) BETA TYPE STIRLING CYCLE DEVICE

(75) Inventor: Ronald James Steele, Scappoose, OR (US)

(73) Assignee: Ronald J. Steele, Scappoose, OR (US)

( * ) Notice: Subject to any disclaimer, the term of this patent is extended or adjusted under 35 U.S.C. 154(b) by 244 days.

(21) Appl. No.: 10/704,845

(22) Filed: Nov. 10, 2003

Related U.S. Application Data

(60) Provisional application No. 60/448,070, filed on Apr. 18, 2003.

(51) Int. Cl.

| | |
|---|---|
| ***F01B 29/10*** | (2006.01) |
| ***F01B 3/04*** | (2006.01) |
| ***F01B 9/06*** | (2006.01) |
| ***F02B 75/18*** | (2006.01) |
| ***F02G 1/04*** | (2006.01) |

(52) U.S. Cl. ..... 60/517; 60/519; 60/520; 60/525

(58) Field of Classification Search ..... 60/517, 60/519, 520, 525

See application file for complete search history.

(56) References Cited

U.S. PATENT DOCUMENTS 5,394,700 A 3/1995 Steele
5,442,913 A * 8/1995 Cho et al. ..... 60/519
5,533,335 A * 7/1996 Shin ..... 60/519
2003/0074897 A1 * 4/2003 Rollston ..... 60/519

OTHER PUBLICATIONS

U.S. Appl. No. 60/448,070, Steele.

* cited by examiner

*Primary Examiner*—Sheldon J Richter

(57) ABSTRACT

A coaxial Beta type Stirling cycle device, having a power piston and a displacer coaxially positioned in series within an enclosing cylinder. The power piston and power piston shaft have an opening wherein the displacer shaft passes through. A compression chamber is formed between the pistons. An expansion chamber is formed between the displacement piston and one end of the cylinder. There is a gas path provided, so that a working gas within the cylinder can pass back and forth between the expansion chamber and the compression chamber as the pistons reciprocate. The power piston and the displacer each has its own linkage to a common cam body, which has a cam groove for the power piston and a cam groove for the displacer. The cam body is a face cam having multiple cam grooves, or a barrel cam having multiple cam grooves. The cam grooves may be shaped to provide infinitely settable stroke, dwell, and phase angle. A plurality of single-cylinder devices can share a single common barrel cam and shaft, thus making a multi-cylinder "cluster" configuration engine. Each cylinder, combined with its pistons and yoke assemblies, is identical and easily replaceable, thus providing improved reliability, maintainability and reduced part count.

13 Claims, 3 Drawing Sheets

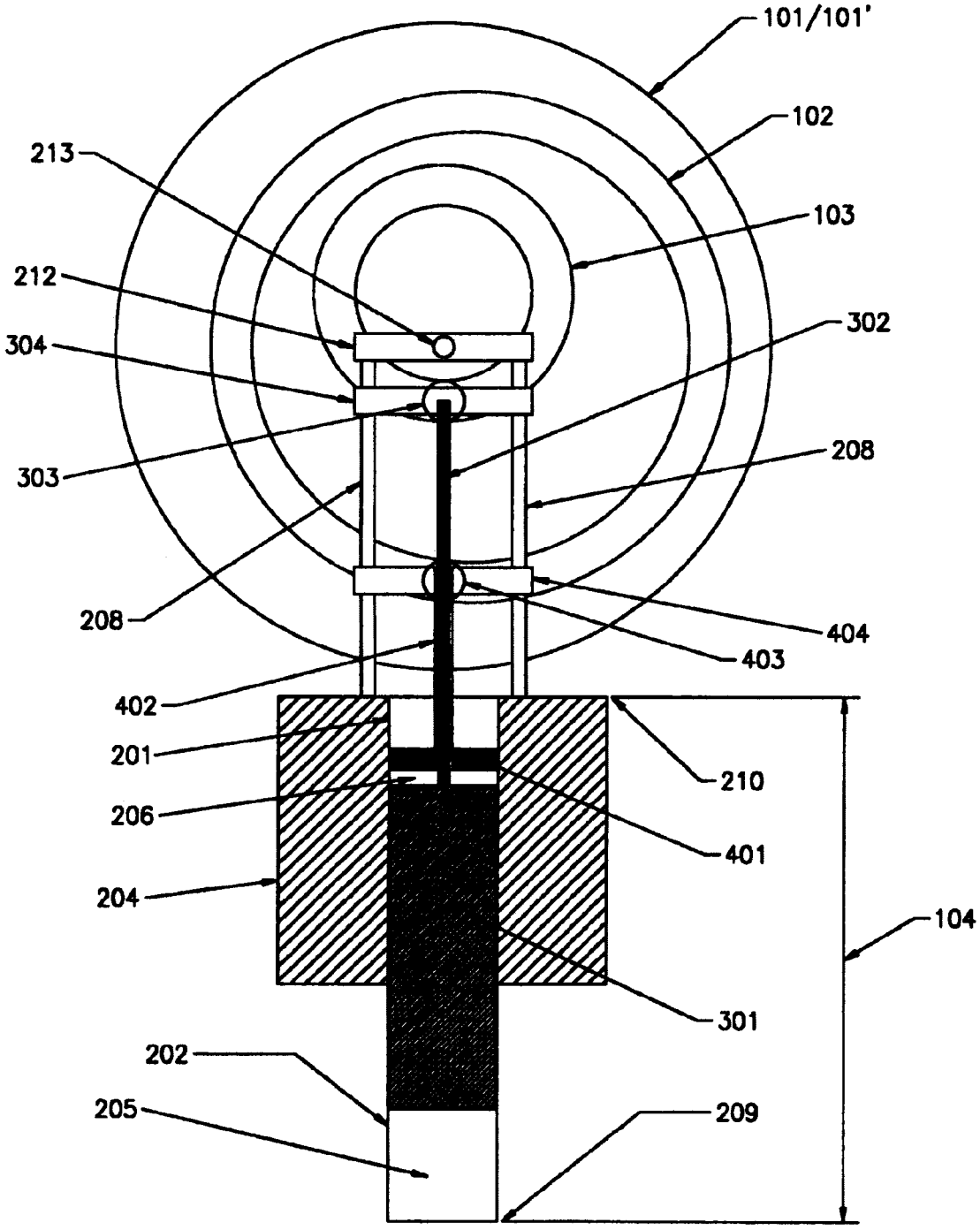
FIGURE #1 100'

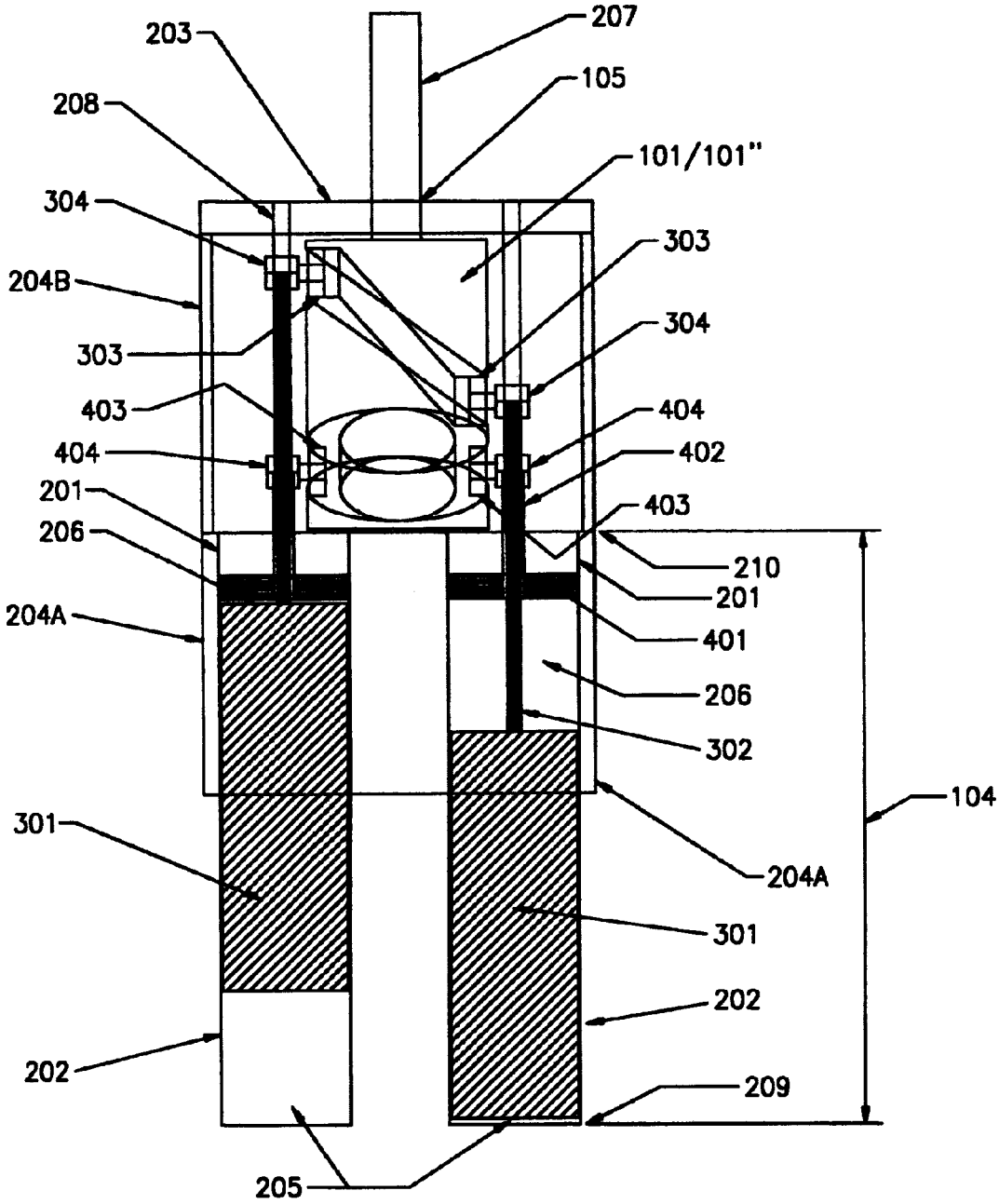
FIGURE #2 100''

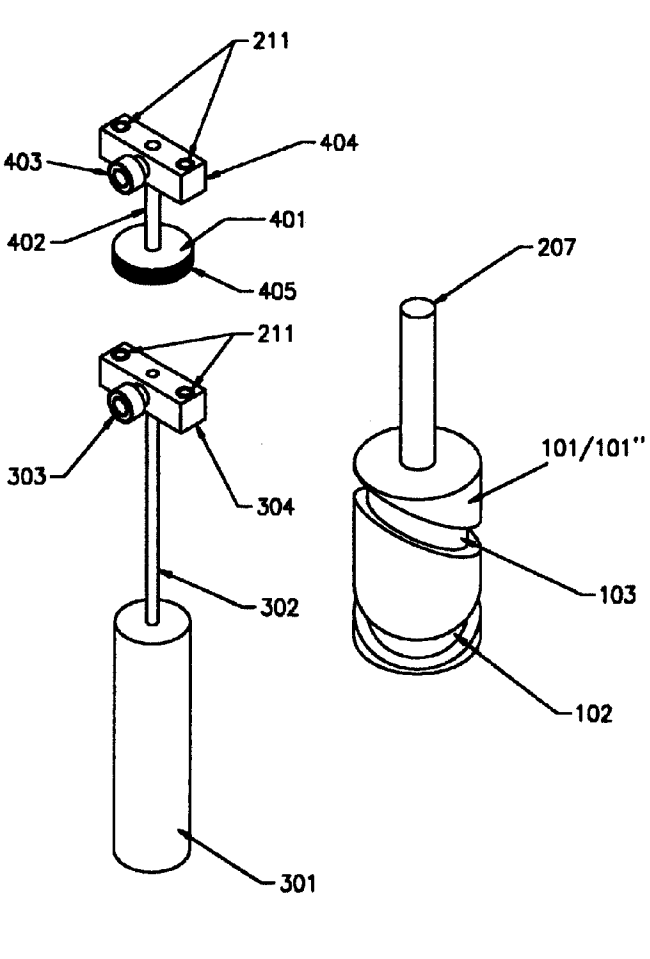
FIGURE #4 100''
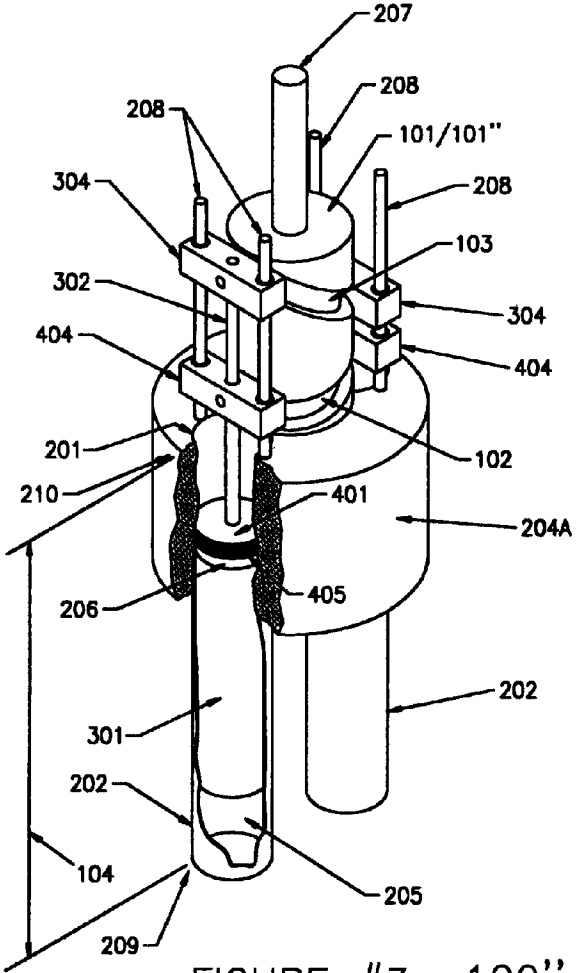
FIGURE #3 100''

BETA TYPE STIRLING CYCLE DEVICE

CROSS-REFERENCE to RELATED APPLICATIONS

This application is entitled to the benefit of Provisional Patent Application Ser. No. 60/448,070, filed 2003 Apr. 18.

STATEMENT REGARDING FEDERALLY SPONSORED RESEARCH and DEVELOPMENT

Not applicable.

BACKGROUND OF THE INVENTION

1. Field of the Invention

This invention relates to Stirling cycle devices, specifically linearly driven single- and multi-cylinder Beta type devices.

2. Description of the Prior Art

Stirling cycle devices are well-known, and are operable as engines or heat pumps. Thermodynamic properties of a working gas contained within the device are exploited by compression, expansion, heating, and cooling, according to the Stirling thermodynamic cycle of the working gas, wherein more energy is obtained from the expansion of a heated quantity of gas than is required to compress the same quantity of gas that is cooled.

When the device is operated as an engine, its basic function is to convert a thermal differential to rotational energy. A thermal differential is externally provided between two physical portions of the device, and the shaft rotates. In this mode, the device is an engine.

When the device is operated as a heat pump, its basic function is to convert rotational energy of a shaft to a thermal differential. The shaft is rotated by external means, and the device produces a thermal differential between two physical portions of itself.

(For simplicity, unless otherwise noted, this narrative assumes that the device under description is being operated as an engine, and it is understood that the device could be operated as a heat pump by reversing operation. Conversely, if heat pump mode is being described, it is understood that the device could be operated as an engine by reversing operation.)

Many techniques have been developed to increase the effectiveness of the Stirling cycle device. Usually these techniques involve excessive mechanical linkages or size, exotic materials, and unusual construction methods. Although effectiveness may be improved, expense and complexity are increased, which reduces the device's viability.

U.S. Pat. No. 5,394,700, "Stirling Engine with Ganged Cylinders and Counter Rotational Operating Capability", inventor Steele, is hereby incorporated by reference.

SUMMARY OF THE INVENTION

Disclosed herein is a new Beta type Stirling engine, where the power piston and the displacer coaxially occupy a common cylinder. The cylinder is sealed to allow a working gas contained within to be contained at a higher pressure than the atmosphere surrounding the cylinder. Inventive linkage is provided so that the engine can be engaged with cam grooves provided in a cam body such as a face cam or a barrel cam. As the cam body turns, the cam grooves operate the linkage so that the strokes of the power piston and displacer are out of phase by a phase angle determined by the positions shapes of the cam grooves, relative to each other. The grooves in the cam body can be shaped to provide any stroke, dwell, and phase angle desired.

The engine otherwise operates like a conventional Stirling engine, where a thermal differential is provided between the displacement chamber and the compression chamber. Typically, heat is applied to the displacer end of the engine, and a cold region is provided around the compression chamber.

The cam body can be within the pressurized assembly, as illustrated, with only the output shaft extending out of the pressurizable housing.

In its simplest implementation, a single cylinder would be used with a face cam. If a barrel cam is used, a plurality of single-cylinder engines can be engaged into a common barrel cam, thus making a composite multi-cylinder barrel-cam or "clustered" engine. Cylinder counts of 1, 2, 3, 4, 5, 6, or even more are achievable.

Previous multi-cylinder Stirling engines have been referred to as "square-four", "inline", "V", "radial", "horizontal opposed". The "cluster" configuration specified herein is new and unique to Stirling devices.

OBJECTS and ADVANTAGES

Included among the objects and advantages of this invention are:

1. To provide compact, elegant, and highly versatile design.
2. To provide a device which is easy to pressurize and maintain pressurization.
3. In engine mode, to provide a device which produces a rotary output from a linear piston movement. Conversely, to provide linear Stirling action and benefits (such as for a heat pump), through use of a rotary input.
4. To minimize the number of moving parts, by virtue of the inventive linkage.
5. To minimize weight, by virtue of minimal moving parts and compact design.
6. To provide a design which allows for a simple implementation of a multi-cylinder beta type Stirling engine configuration. This is the first drive to allow 'clustered' cylinders, whether an even or an odd number, other than the square four or multiple of two.
7. To simplify construction, operation, and maintenance, thus increasing reliability and efficiency, while reducing expense and requirement for specialty construction methods and materials. In a multi-cylinder engine, each single-cylinder unit is identical, allowing reduction of replacement parts. The design allows for easy manufacture and maintenance due to single acting pistons and the parallel output shaft.
8. To provide an infinitely settable stroke, dwell, and phase angle, by virtue of the configuration of the cam grooves. The path of the continuous sinusoidal grooves in the cam body can be shaped to maximize or minimize each stroke and/or dwell of its piston or pistons. Further, the grooves can be shaped to provide multiple piston reciprocations per revolution.
9. To provide an engine design which includes well-supported and strong assembly, with minimal contact points, thus improving reliability and reducing wear due to operation.

DRAWING FIGURES

List of Drawing Figures:

FIG. 1 shows a sectional view of a Stirling cycle device 100' in accordance with a single-cylinder face cam embodiment, with external linkage.

FIG. 2 shows a side view of a two-cylinder embodiment.

FIG. 3 shows an isometric view of selected portions of a two-cylinder embodiment.

FIG. 4 shows an isometric view of power piston 401, displacer 301, and barrel cam 101".

LIST OF REFERENCE NUMERALS

100' is an embodiment of the inventive device, with external linkage and a face cam.
100" is an embodiment of the inventive device, with internal linkage, a barrel cam, and multiple cylinders.
101 is a cam body, which can be configured as a face cam 101' or barrel cam 101".
101' is a face cam.
101" is a barrel cam.
102 is a power piston cam groove in cam body 101.
103 is a displacer cam groove in cam body 101.
104 is a thermal differential between 'hot' region 210 and 'cold' region 211.
105 is an output shaft seal, located between bulkhead 203 and output shaft 208.
201 is a cylinder within housing 204.
202 is a displacer cylinder.
203 is a bulkhead, attached to housing 204.
204 is a housing.
204*a* is a block portion of housing 204.
204*b* is a case portion of housing 204.
205 is a displacement chamber.
206 is a compression chamber.
207 is an output shaft.
208 is a guide rod.
209 is a 'hot' region.
210 is a 'cold' region.
211 is a guide rod hole.
212 is a guide rod keeper.
213 is a face cam pivot.
301 is a displacer.
302 is a displacer shaft.
303 is a displacer cam roller.
304 is a displacer yoke.
401 is a power piston.
402 is a hollow power piston shaft, through which displacer shaft 302 passes.
403 is a power piston cam roller.
404 is a power piston yoke.
405 is a power piston seal, sealing between power piston 401 and cylinder 201.

DESCRIPTION AND OPERATION OF FIRST EMBODIMENT

FIG. 1 shows cylinder 201, containing displacer 301 and power piston 401. Displacement chamber 205 is formed between displacer 301 and a first end of cylinder 201. Compression chamber 206 is formed between displacer 301 and power piston 401.

Displacer shaft 302 is connected to displacer 301. Hollow power piston shaft 402 is connected to and penetrates power piston 401. Displacer shaft 302 passes through power piston 401 and hollow power piston shaft 402 as shown. This construction allows independent coaxial action of shafts 302 and 402, which terminate at yokes 304 and 404. Mounted to yoke 304 is cam roller 303. Mounted to yoke 404 is cam roller 403. Yokes 304 and 404 are kept in alignment by guide rods 208 as shown. Cam rollers 303 and 403 engage cam grooves 102 and 103, respectively, in a cam body configured as face cam 101'. As cam 101' turns, cam grooves 102 and 103 and cam rollers 303 and 403 interact to cause a fixed reciprocating relationship between the motions of power piston 401 and displacer 301. Cam grooves 102 and 103 can be infinitely shaped to cause whatever stroke, dwell, and phase angle is desired for piston 401 and displacer 301. Multiple cycles per cam 101" revolution can also be provided. In the Figures, a single cycle per cam 101" revolution is shown.

Guide rods 208 are fixed at one end to engine bulkhead 203, and fixed at the other end with guide rod keeper 212, which also supports face cam 101' at face cam pivot 213, located at rotational center of face cam 101'.

Device 100 is operated like a conventional Stirling device. The application of thermal differential 104 causes power piston 401 and displacer 301 to reciprocate, thus turning cam 101'. Conversely, turning of cam 101' will produce thermal differential 104, thus operating as a heat pump.

DESCRIPTION AND OPERATION OF SECOND EMBODIMENT

FIG. 2 shows multiple cylinders 201 engaged with shared barrel cam 101". For each cylinder 201, construction is the same as described for first embodiment 100' in FIG. 1, except that cam body 101 is barrel cam 101" instead of face cam 101'.

Since cylinders 201 are oriented in the same direction, their hot and cold regions 209 and 210 coincide, and multi-cylinder engine 100" is operated like a conventional Stirling device.

These embodiments meet Objects and Advantages listed above, as follows—

The embodiments shown have the minimum possible moving parts for a device of this type. Consequently, it is compact, elegant, highly versatile, and minimal in weight. Reduction of moving parts improves manufacturability and reliability.

It can be seen, that by having a single shaft penetration from the pressurized area to the non-pressurized area, that only one housing seal is needed, and pressurization is improved.

It can also be seen that rotary output of the cam is produced by linear action of the power piston.

It can also be seen that the cam grooves are infinitely configurable, thus providing infinitely settable stroke, dwell, and linear reciprocation cycles per cam revolution.

It can also be seen that the design has a well-supported and strong assembly. The use of guide rods to support and guide the yokes adds superior alignment capabilities to the beta type Stirling design that has not existed in the past and has always been a weakness which has required at times the addition of rollers or guides within the displacer cylinder. This alignment feature constrains the displacer and the power piston to remain centered within the cylinder and to not rub or touch the cylinder wall. In the case of the power piston, only the power piston seal actually touches the cylinder wall thus reducing friction and wear of these vital components, thus improving reliability.

The preferred "clustered" embodiment has the additional advantage that all pistons, displacers, linkages, and the cam, are all contained within a common pressurizable housing. The only moving element that passes through the housing is the single output shaft, thus providing a very pressurizable housing by virtue of a single output shaft seal.

CONCLUSION, RAMIFICATIONS, AND SCOPE

While there is shown and described a preferred embodiment of the invention, it is to be distinctly understood that this invention is not limited thereto but may be variously embodied to practice within the scope of the following claims.

For example, if a perfectly pressurizable engine housing is desired, a magnetic coupling may be used to transfer power through the housing, rather than an output shaft.

Further, electromechanical conversion means can be included within the pressurizable housing, coupled to the output shaft. In this fashion, electromechanical conversion means such as a motor, alternator, or generator, and the Stirling device can be contained within one pressurizable housing, and only motor/generator wires pass through the housing, thus maximizing integrity of the pressurizable housing because no shaft seals are required, and making a hermetically sealed device possible. In this fashion, a hermetically sealed Stirling heat pump or Stirling generator can be provided.

Further, although the inventive device is described as an engine that can convert thermal energy to mechanical kinetic energy, said device is also operable as a heat pump, as is well known in the Stirling art. Consequently, as a heat pump, 'hot' region and 'cold' region can be transposed, depending on which direction the output shaft is rotated.

I claim:

1. A coaxial Beta type Stirling device, having infinitely settable stroke, dwell, and phase angle, comprising:

a cam including a first groove and a second groove to obtain said infinitely settable stroke, dwell, and phase angle.

2. A clustered Stirling engine, having infinitely settable stroke, dwell, and phase angle, wherein a plurality of coaxial Stirling devices share a single cam body, wherein said coaxial Striring devices includes a power piston cam groove and a displacer cam groove.

3. The engine of claim 2, wherein said cam body has an output shaft.

4. The engine of claim 2, wherein said cam body has electromagnetic means of power transmission.

5. A clustered Stirling engine, having infinitely settable stroke, dwell, and phase angle, wherein a plurality of coaxial Stirling devices cohabit a single pressurizable housing, wherein said coaxial Striring devices includes a power piston cam groove and a displacer cam groove.

6. The engine of claim 5, further comprising electromagnetic power transmission means to transfer power between the engine and said housing's exterior.

7. A coaxial Stirling device having infinitely settable stroke, dwell, and phase angle, comprising:

a first enclosing cylinder in a pressurizable housing;

a first power piston within said first cylinder and slidably sealed against it, having a first hollow power piston shaft which terminates at a first power piston yoke, said first power piston yoke having a first power piston cam roller;

a first displacer within said first cylinder, having a first displacer shaft which passes through said first hollow power piston shaft and terminates at a first displacer yoke, said first displacer yoke having a first displacer cam roller;

wherein said first power piston yoke and said first displacer yoke are guided by a first guide rod which is mounted to said housing;

wherein said first displacer and said first power piston are enclosed in series within said first cylinder, a first compression chamber is formed between said first displacer and said first power piston, and a first expansion chamber is formed between said first displacer and one end of said first enclosed cylinder;

a gas path between said first expansion chamber and said first compression chamber;

a working gas, moveable within said first expansion chamber and said first compression chamber;

a cam body having an infinitely configurable displacer cam groove and an infinitely configurable power piston cam groove;

wherein said first power piston cam roller is mated with said power piston cam groove and said first displacer cam roller is mated with said displacer cam groove.

8. The Stirling device of claim 7, further comprising an output shaft connected to said cam body.

9. The Stirling device of claim 7, further comprising electromagnetic power transfer means, attached to said cam body.

10. A clustered Stirling device, comprising the coaxial Stirling device of claim 7, and further comprising:

at least a second enclosing cylinder in said pressurizable housing, radially distributed with respect to said first enclosing cylinder;

each of said at least second enclosing cylinders having its own power piston, hollow power piston shaft, power piston yoke, power piston cam roller, displacer, displacer shaft, displacer yoke, displacer cam roller, guide rod, expansion chamber, compression chamber, gas path, all configured like said first enclosing cylinder, power piston, hollow power piston shaft, power piston yoke, power piston cam roller, displacer, displacer shaft, displacer yoke, displacer cam roller, guide rod, expansion chamber, compression chamber, and gas path;

wherein all of said power piston cam rollers are mated with said power piston cam groove and wherein all of said displacer cam rollers are mated with said displacer cam groove.

11. A clustered Stirling device, having infinitely settable stroke, dwell, and phase angle, comprising:

a pressurizable housing, having a plurality of radially distributed enclosing cylinders, each of said plurality of enclosing cylinders having a slidably sealed power piston which has a hollow power piston shaft which terminates at a power piston yoke which has a power piston cam roller, and each of said plurality of enclosing cylinders also having a displacer in series with said power piston and which has a displacer shaft passing through said power piston shaft and terminating at a displacer yoke which has a displacer cam roller, wherein the power piston yoke and displacer yoke of each of said enclosing cylinders are guided by their own guide rod mounted to said housing;

a cam body having an infinitely configurable displacer cam groove and an infinitely configurable power piston cam groove;

wherein said power piston cam rollers are mated with said power piston cam groove, and said displacer cam rollers are mated with said displacer cam groove.

12. The Stirling device of claim 11, further comprising an output shaft connected to said cam body.

13. The Stirling device of claim 11, further comprising electromagnetic power transfer means, attached to said cam body.

* * * * *